United States Patent [19]

Wilson

[11] Patent Number: 4,756,451

[45] Date of Patent: Jul. 12, 1988

[54] CHILD RESISTANT CLOSURE WITH ENERGY PLANES

[75] Inventor: Woodrow S. Wilson, Johnston, R.I.

[73] Assignee: Polytop Corporation, Slatersville, R.I.

[21] Appl. No.: 77,757

[22] Filed: Jul. 27, 1987

[51] Int. Cl.[4] ..... B65D 25/46

[52] U.S. Cl. ..... 222/534; 215/203; 222/536; 222/153

[58] Field of Search ..... 215/203, 235, 237, 238; 222/153, 182, 534, 535, 536

[56] References Cited

U.S. PATENT DOCUMENTS

| | | | |
|---|---|---|---|
| 3,169,673 | 2/1965 | Focht | 222/182 |
| 3,568,895 | 3/1971 | Porter | 222/534 |
| 3,677,445 | 7/1972 | Linkletter | 222/153 |
| 3,702,165 | 11/1972 | Carow et al. | 222/153 |
| 3,718,238 | 2/1973 | Hazard et al. | 222/536 |
| 3,786,964 | 1/1974 | Landen | 222/153 |
| 3,873,005 | 3/1975 | Hazard | 222/153 |
| 3,957,181 | 5/1976 | Hazard | 222/534 |
| 4,047,643 | 9/1977 | Hazard | 222/153 |
| 4,081,113 | 3/1978 | Hazard | 222/534 |
| 4,209,114 | 1/1980 | Wilson et al. | 222/536 |

*Primary Examiner*—Stephen Marcus
*Assistant Examiner*—Nova Stucker
*Attorney, Agent, or Firm*—Karen M. Gerken; Martin P. Hoffman; Mitchell B. Wasson

[57] ABSTRACT

A child resistant dispensing closure of the type having a cap and a spout mounted thereon for rotation about a substantially horizontal axis. The upper surface of the cap is provided with a pattern of ribs. The upper surface of the spout is provided with a plurality of ribs, each of which has a distinct energy plane. All but one of the energy planes fails to allow sufficient purchase on their respective ribs and fails to produce the proper force vector required in order to initiate rotation of the spout when a manual force is applied to the latter energy planes. Only one of the energy planes is adapted so as to allow sufficient purchase and to produce the proper force vector required in order to initiate rotation of the spout when a manual force is applied to said one plane. The plurality of ribs provided on the spout, in conjunction with the pattern of ribs provided on the cap, blend together and serve to distract and confuse a child or other individual of reduced mental capacity, thereby effectively reducing to negligible the probability that the child or other individual would inadvertently discover the sole energy plane capable of realizing rotation of the spout while exploring the dispensing closure with the fingers, fingernails, teeth or other objects. The spout may be mounted on the cap in such a manner as to require relatively little rotational torque for rotation, thereby making the dispensing closure convenient and easy to utilize by adults, even those not possessing normal physical strengths.

9 Claims, 2 Drawing Sheets

CHILD RESISTANT CLOSURE WITH ENERGY PLANES

BACKGROUND OF THE INVENTION

1. Field of the Invention

This invention generally pertains to a child resistant dispensing closure. More particularly, this invention relates to a child resistant dispensing closure employing a cap and a spout. Such closures are normally constructed so that the spout is rotatably mounted within a cavity formed in the cap in such a manner as to be capable of being rotated between an open position in which a passage through the spout is aligned with an opening through the top of the cap, and a closed position in which the spout closes off the opening through the cap. Such dispensing closures may be constructed in a number of diverse manners.

While closures of this type are extremely utilitarian, a critical feature which limits their commercial applicability and acceptance is the ease with which the closure may be opened and, hence, access to the contents of the associated container gained. Although facility of operation may, at first blush, appear to be advantageous, closures utilized with hazardous or similar materials must be relatively difficult to open so that comparatively young children or those of reduced mental capacity cannot open them under normal circumstances. However, the dispensing closure must also be sufficiently easy to open so that it may be conveniently operated by individuals of normal mental capacity, even if such individuals do not possess what may be regarded as normal physical strengths.

In response to the foregoing problem, efforts have been made to provide rotatable spout dispensing closures with detents or detent-like structure intended to render the spouts in said closures relatively difficult to open. Closures of this type have failed to be sufficiently child resistant in character to be acceptable from a commercial standpoint. Many of these closures essentially rely on relatively high rotational torque levels in order to satisfy child resistant standards. Consequently, the spouts must be inserted into the caps in such a manner as to require a minimum of two or three pounds of rotational torque in order to resist the manipulation efforts of a child. These high rotational torque levels consequently render adult operation more difficult and thereby reduce the commercial feasibility of the dispensing closure.

Moreover, presently known dispensing closures of the foregoing type have been disappointing in responding to child resistant demands. Even where a deliberate attempt has been made to provide a rotatable or pivotable spout dispensing closure with child resistant properties, the child resistant features have generally proven to be penetrable by even ordinary children. Thus, previously adopted safety features of diverse variety have, in reality, proven to be inadequate in preventing unauthorized, and potentially harmful, access to the contents of a container through the attached dispensing closure.

The instant invention addresses the foregoing problems and deficiencies by providing a dispensing closure characterized by a cap and a rotatable spout, the spout having a unique configuration of energy planes which effectively preclude even inadvertent successful manipulation by a child. The subject dispensing closure achieves this objective by providing a spout which is not only child resistant, but which is characterized by relatively little rotational resistance so as to render the closure more adult receptive.

2. Description of the Prior Art

Dispensing closures of the type having a cap and a rotatable spout, as heretofore described, are known in the prior art. Examples of such prior art dispensing closures are shown in U.S. Pat. Nos. 3,568,895, 4,209,114 and 4,219,138.

U.S. Pat. No. 3,568,895, issued on Mar. 9, 1971 to Porter, discloses a dispensing closure cap for a container wherein the top portion of the cap is formed with a slot for receiving a spout. The arm of the spout extends through the slot whereby pivotal movement of the spout causes a passageway in the spout to register with an outlet hole provided in an insert of the cap.

U.S. Pat. No. 4,209,114, issued on June 24, 1980, to Wilson et al, is directed to a dispensing closure structure including a cap member which is provided with aligned bearings and a movable spout having trunnions fitting within the bearings.

U.S. Pat. No. 4,219,138, issued on Aug. 26, 1980 to Hazard, pertains to a dispensing closure comprising a cap 12 having an elongated slot 24 with bearing openings 28. Trunnions 32 on spout 14 are adapted to be disposed within the bearing openings for rotatably mounting the spout.

The above-noted prior art patents illustrate the utilitarian nature of closures of the type heretofore described. However, these prior art patents further expose the aforementioned deficiency which limits commercial applicability and success for such dispensing closures. This deficiency resides in the fact that such closures tend to be relatively easy to open and, therefore, present little, if any, protection against unauthorized access by children or other individuals of reduced mental capacity.

It is further known in the prior art to provide child resistant features on dispensing closures of the rotatable spout type. Illustrative of child resistant dispensing closures of this type are U.S. Pat. Nos. 3,718,238, 3,786,964 and 3,957,181.

U.S. Pat. No. 3,718,238, issued on Feb. 27, 1973 to Hazard et al, discloses a safety dispensing closure wherein the rotatable spout is recessed within the closure in the closed position. A recess structure provided in the closure top is utilized for engaging the spout so as to rotate it to an open position. Coacting detent means lock the spout in a closed position against inadvertent or accidental movement.

U.S. Pat. No. 3,786,964, issued on Jan. 22, 1974 to Landen, pertains to a safety mechanism for a liquid dispensing container wherein dogging elements automatically set a dogged condition for a rotatable nozzle at the container closing position. A totally separate manual actuation of a latch mechanism is required to disengage the dogged condition in order to permit nozzle actuation to the liquid dispensing position.

U.S. Pat. No. 3,957,181, issued on May 18, 1976 to Hazard, discloses a child resistant dispensing closure having a spout which fits entirely within an elongated groove in a cap when the spout is in a closed position. The end of the spout which is normally engaged to move the spout between open and closed positions is located within the groove. Spout movement is initiated by applying pressure to a portion of the spout remote from the latter end of the spout.

It is evident from the foregoing that prior art child resistant dispensing closures of the type having a rotatable spout have generally relied upon either diverse locking mechanisms to maintain the spout in a closed position or upon complex designs intended to require a sequence of manipulative motions. Thus, the prior art fails to provide a rotatable spout dispensing closure which is not only effective and reliable from a child resistant viewpoint, but which is also susceptible to easy adult operation, which is desirable from an aesthetic and a utilitarian standpoint, and which is cost effective.

SUMMARY OF THE INVENTION

The invention is directed to a child resistant dispensing closure of the type comprising a cap and a rotatable spout. The cap is provided with a planar top and a dependent peripheral skirt adapted to cooperate with a suitable container or being formed integral therewith. An elongated cavity is provided in the top of the cap and includes a bottom wall having an opening which communicates with the interior of the dispensing closure. The cavity is further defined by a pair of side walls formed with aligned bearing openings. A pattern of transverse ribs is formed in the upper surface of the top of the cap.

An elongated spout has a through passage extending longitudinally therethrough from a first or base end to a second end. The spout is provided with a pair of aligned trunnions adapted to be received within the bearing openings formed in the cap such that the spout lies entirely within the cavity provided in the cap when the spout is in the closed position. In this closed position, the opening provided in the cap is closed off by the spout and access to the contents of the container is prohibited.

Access to the contents of the associated container is realized by rotating the spout such that the through passage in the spout and the opening in the cap are aligned. In this regard, rotation of the spout is initiated by applying a manual force to the energy plane of a rearmost rib provided on the upper surface of the spout at its base end. The slope of this energy plane is such as to allow sufficient purchase on the spout and is located so as to provide the proper force vector for rotation of the spout when a manual force is exerted upon the energy plane. Application of manual force against this energy plane rotates the spout a sufficient extent to permit the user to grasp the second end of the spout to further rotate it to the open position.

The dispensing closure is rendered child resistant by providing additional ineffective ribs on the upper surface of the spout, these additional ribs being ineffective to rotate the spout, thereby making it highly improbable that a child or an adult of slight mental ability would select the sole rearmost rib which is capable of rotating the spout. The additional ribs are provided on the spout forward of the center line through the opening in the cap and the axis of rotation of the spout. Moreover, these ribs are provided with respective energy planes which have slopes that fail to allow sufficient purchase to rotate the spout when manual force is applied to the energy planes and which result in force vectors that are not properly directed for affording rotation of the spout. The ribs do, however, successfully divert and confuse a child or individual of impaired mental capacity.

The inconsequential probability that a child or individual of infirm mental capacity would inadvertently discover the sole rib capable of operating the rotatable spout is even further diminished by the pattern of ribs formed on the upper surface of the top of the cap. The pattern of ribs, in conjunction with the ribs formed on the spout, reduce to negligible the possibility that a child, or other individual of similar mental capability, exploring the cap with fingers, objects or teeth, would locate the only proper rib for successful operation of the spout. For a small child, the teeth provide the primary tool in opening a closure. Although visual observation and intellect may indicate to a child that only the rearmost rib will open the closure, the child's orientation is lost when the closure is put to the mouth and the teeth have many ribs to select.

BRIEF DESCRIPTION OF THE DRAWINGS

Further details of the present invention are best expressed with reference to the accompanying drawings in which.

DETAILED DESCRIPTION OF THE PREFERRED EMBODIMENT

Figure 1:
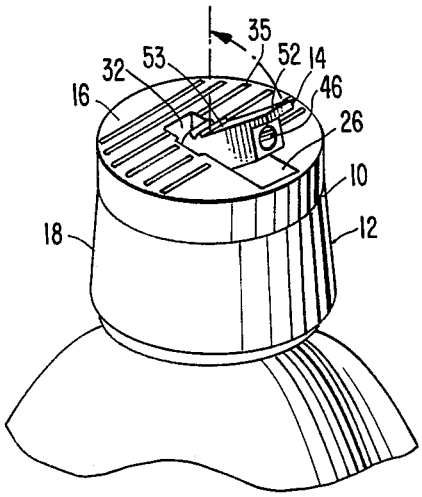
FIG. 1 is a perspective view of the dispensing closure of the present invention showing the dispensing spout partially raised.
Figure 2:
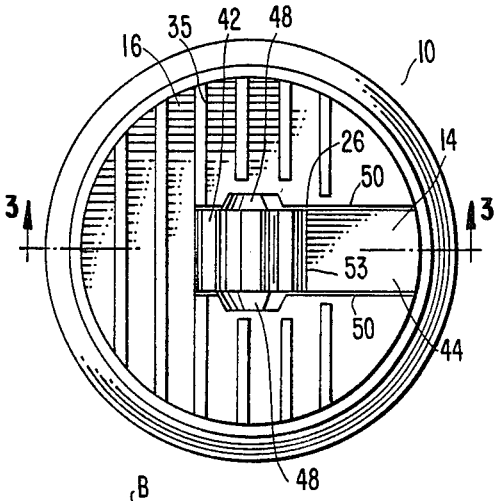
FIG. 2 is a top plan view of the dispensing closure of the present invention.
Figure 3:
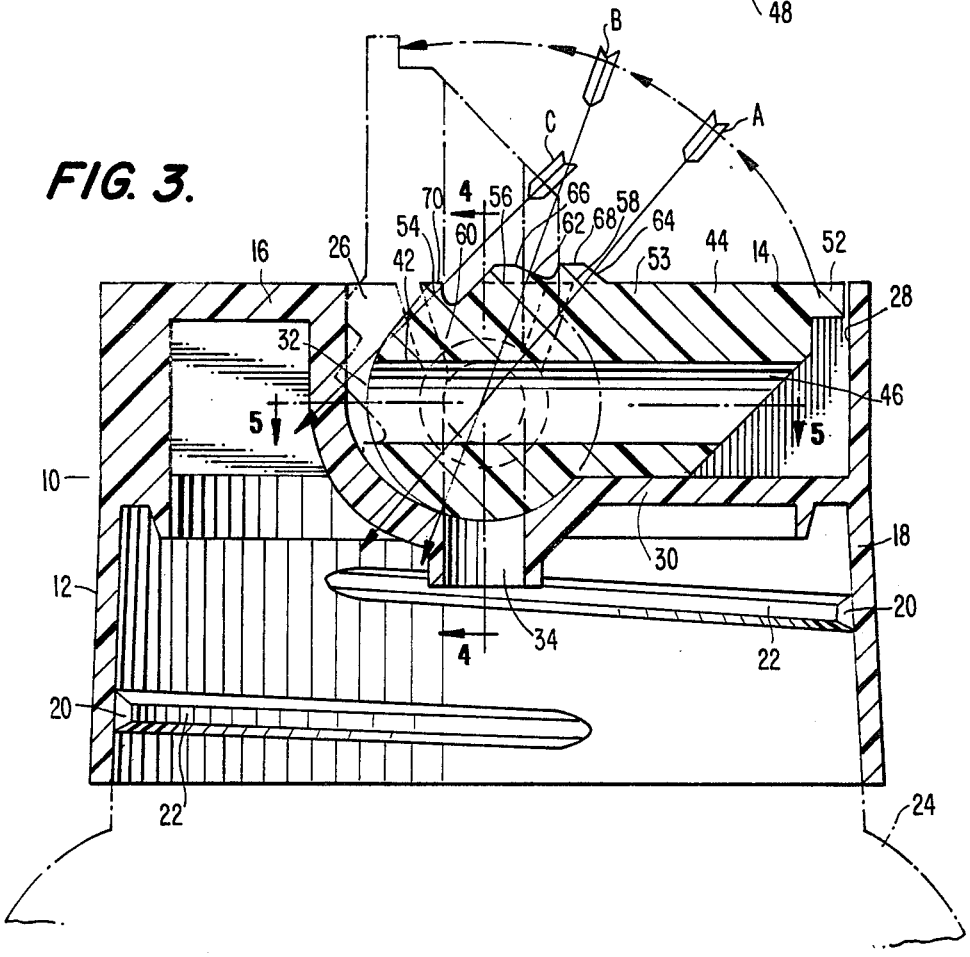
FIG. 3 is an exploded cross-sectional view of the dispensing closure of the present invention taken along line 3—3 of FIG. 2.

Referring to FIGS. 1–3, there is shown a dispensing closure 10 in accordance with this invention having a closure body or cap 12 and a spout 14. These two parts may be conveniently formed so that each is an integral unit by means of common high speed injection molding techniques.

The cap 12 is defined by a planar top 16 terminating in a dependent peripheral skirt 18. As shown in FIG. 3, the interior of the skirt is provided with conventional securing means, such as threads 20, for cooperating with similarly configured means, such as recesses 22, formed in the neck of a container 24 for attaching the dispensing closure thereto. Various other equivalents known in the art may be substituted for the threads 20 and recesses 22. Moreover, the skirt 18 may, if desired, be formed integral to the container wall by means of known molding processes.

As is best depicted in FIGS. 1–4, top 16 is of substantially flat configuration and is provided with an elongated cavity 26. The cavity 26 extends from within the central region of the top 16, terminating adjacent to the interior of the skirt at 28 as shown in FIG. 3. With further reference to FIG. 3, cavity 26 is defined by a bottom wall 30 and an enlarged end 32. An opening 34 is provided in the bottom wall of the cavity at the enlarged end to establish communication between the cavity 26 and the interior of the dispensing closure. A pattern of transverse ribs 35 is formed on the upper surface of the top 16 for a purpose to be hereinafter described.

Figure 4:
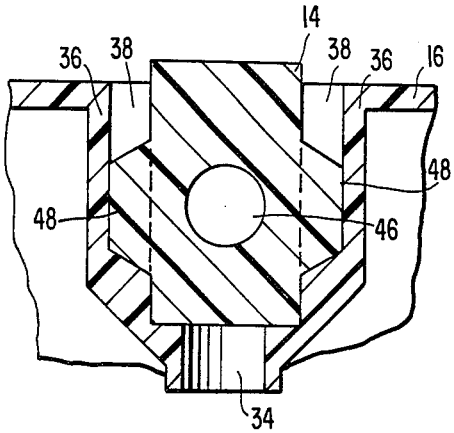
FIG. 4 is a transverse vertical cross-sectional view of the dispensing closure of the present invention taken along line 4—4 of FIG. 3.
Figure 5:
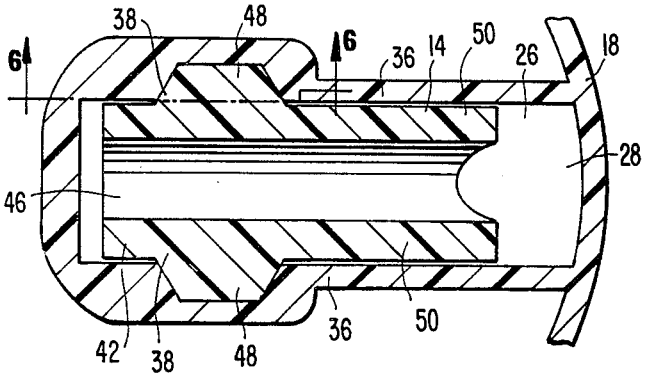
FIG. 5 is a horizontal cross-sectional view of the dispensing closure of the present invention taken along line 5—5 of FIG. 3.
Figure 6:
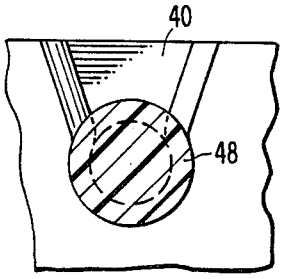
FIG. 6 is a fragmentary vertical cross-sectional view of the dispensing closure of the present invention taken along line 6—6 of FIG. 5.

Referring to FIGS. 3, 4 and 5, cavity 26 is further defined by parallel vertically oriented side walls 36. A bearing opening 38 is provided in each of the side walls 36 opening into the enlarged end 32 of the cavity 26. The bearing openings have aligned axes, which establish the axis of rotation for the spout 14, and are each provided with tapered, slot-type entrances 40 best illustrated in FIG. 6.

Spout 14 is of elongated configuration having a first or base end 42 and a second end 44. A through passage 46 extends longitudinally through the spout from the first to the second end. Aligned trunnions 48 are provided on the spout on the base end. These aligned trunnions 48 may be forced downwardly into and through the slot-type entrances 40 so as to be "popped" into place within the bearing openings 38 in such a manner that the spout 14 may be rotated from a closed position as shown in FIGS. 2 and 3 to an open position as indicated in phantom in FIG. 3. Preferably, both the trunnions and the bearing openings are shaped as the frustrum of a circular cone, although other known types of structures can be utilized for rotatably mounting the spout 14 upon the cap 12.

As is best illustrated in FIG. 3, spout 14 is constructed so as to lie entirely within the cavity 26 when the spout is in the closed position. When the spout 14 is rotatably mounted upon the cap 12, the base end 42 of the spout fits within the enlarged end 32 of the cavity 26. The spout is dimensioned so as to have sides 50 which fit within, and slightly spaced from, the side walls 36 of the cavity, as depicted in FIG. 5. The second end 44 of the spout is provided with a projection 52 which terminates adjacent to and just inside of the peripheral skirt at 28. Thus, the projection 52 normally cannot be manually engaged so as to maneuver or rotate the spout.

With particular reference to FIG. 3, it can be seen that, in the closed position, through passage 46 provided in spout 14 is not aligned with the opening 34 provided in the bottom wall 30 of cavity 26, but rather, extends perpendicular thereto. Hence, in the closed position, opening 34 is closed off by the base end 42 of the spout and the contents of the container cannot be released. When the spout is rotated to the open position as shown in phantom in FIG. 3, through passage 46 is aligned with opening 34 and the contents of the container may be released.

As depicted in FIGS. 1 and 2, and, in particular, FIG. 3, the top surface 53 of the spout 14 is provided with a plurality of ribs 54, 56 and 58, three of which are herein shown. Two of these ribs 56, 58 are located forward of the center line of opening 34, which center line extends perpendicular to and intersects the horizontal axis of rotation of spout 14. The ribs 54, 56 and 58 are provided, respectively, with ramp-like forward surfaces or energy planes 60, 62 and 64. Energy plane 64 of rib 58 projects above the top surface 53 of the spout with a slope which, when a manual force is applied to the energy plane, results in the force vector indicated by arrow A in FIG. 3. This manual force may be applied directly by a person's finger or fingernail, a child's tooth, or it may be applied by means of a small object, such as a coin or the like. Similarly, a manual force applied to the energy plane 62 of rib 56 results in the force vector indicated by arrow B in FIG. 3.

It can be seen from FIG. 3 that force vectors A and B represent a force emanating from the energy planes 64 and 62, respectively, and intersecting the horizontal axis of rotation of the spout, and the center line of the opening 34. Thus, the slope of each of the energy planes 62, 64 is such as to fail to provide a proper force vector to rotate the spout when a force is applied to the energy planes. Moreover, the energy planes 62, 64 fail to allow sufficient purchase on their respective ribs 56, 58 in that each of the energy planes is relatively gently sloping and terminates in flat upper surfaces 66, 68, respectively. Hence, any amount of force, whether calculated or inadvertent, applied by any means to the ribs 56 and 58 and, in particular, to their energy planes 62 and 64, will fail to result in any rotational movement of the spout.

Rearmost rib 54, in contrast, is provided with energy plane 60 and is located on the opposite side of the axis of rotation of the spout 14 on the base end 42. Energy plane 60 terminates in a flat upper surface 70, which surface is coplanar with the top surface 53 of the spout 14. The slope of energy plane 60 is such as to result in the force vector designated by arrow C of FIG. 3 when a force is applied thereto. This force vector associated with energy plane 60 is sufficient to initiate rotation of the spout in order to raise the second end 44 of the spout so that projection 52 may be manually grasped and the spout further rotated to the open position shown in phantom in FIG. 3. Additionally, the slope of energy plane 60 is relatively steep so as to allow sufficient purchase on rib 54 to effect rotation of the spout.

The combination of ribs 54, 56 and 58, with only the rearmost rib 54 being capable of providing rotation of the spout 14, provides significant child resistant protection. The several ribs serve to confuse a child or mentally infirm individual, while simultaneously diminishing the probability that the child or other individual of reduced mental capacity will inadvertently select the only rib capable of providing access to the container. The combination of ribs provided on the spout is rendered even more confusing by the pattern of transverse ribs 35 formed on the upper surface of the top 16 of the cap 12. Ribs 35, which blend with the ribs provided on the spout, effectively preclude a child who is randomly exploring the dispensing closure with his teeth or some object from encountering the sole energy plane which will provide both sufficient purchase and the proper force vector to rotate the spout. Hence, the probability that a child will inadvertently successfully manipulate the dispensing closure is reduced to negligible.

Since the instant dispensing closure employs a pattern of confusingly similar ribs to prevent unauthorized operation by a child, the rotational torque of the spout need not be very great. Eliminating reliance on high rotational torques to prevent entry allows the spout to be situated in the cap so as to possess very little rotational resistance. The dispensing closure is thereby rendered more adult receptive in that it may be operated easily and conveniently by an individual possessing less than average physical strengths.

Figure 7:
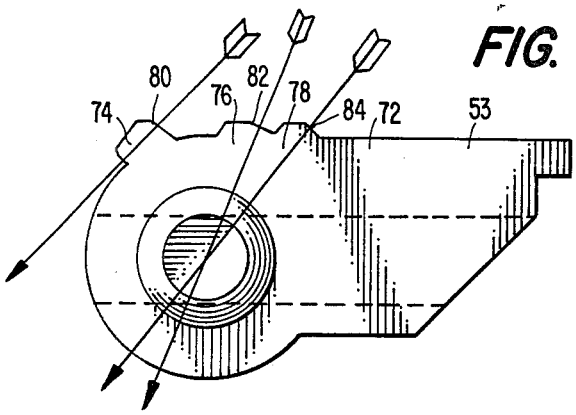
FIG. 7 is a side elevational view of a first alternative embodiment of the dispensing closure of the present invention.

A first alternative embodiment for the spout 14 of the instant dispensing closure is depicted in FIG. 7. As illustrated therein, spout 72 is provided with ribs 74, 76 and 78 having, respectively, energy planes 80, 82 and 84. As previously discussed in connection with spout 14, energy planes 82 and 84 do not provide sufficient purchase, nor do they present the proper force vectors, to rotate spout 72. Only rearmost energy plane 80 slopes upwardly above the top surface 53 of the spout a sufficient extent to provide adequate purchase and the proper force vector to attain rotation of the spout.

While the invention has been described in detail in connection with a preferred embodiment, it is to be understood that various modifications may be made without departing from the spirit and scope of the invention as defined by the appended claims.

What is claimed is:

1. A child resistant closure comprising a cap and a spout, said cap being adapted for attachment to a container, said cap having a top, an opening formed in said cap communicating with the interior of said dispensing closure, a through passage formed in said spout, said spout having an upper surface, said spout being supported within said cap, said spout being adapted for rotation about a horizontal axis between a closed position wherein said spout closes off said opening in said cap and an open position wherein said opening in said cap and said through passage are aligned, a pattern of transverse ribs formed on said top of said cap; and a plurality of ribs formed on said upper surface of said spout, each of said ribs being provided with an energy plane, each of said energy planes terminating in a planar upper surface, all except one of said energy planes preventing sufficient purchase to rotate said spout when a manual force is applied to said energy planes and preventing the proper force vector required to rotate said spout when said force is applied to said energy planes, said one of said energy planes providing sufficient purchase to rotate said spout when said force is applied to said energy plane and producing the proper force vector required to rotate said spout when said force is applied to said plane.

2. A child resistant dispensing closure recited in claim 1 wherein said opening has a center line, said all except one of said plurality of ribs being located forward of said center line, said one of said ribs being located on the opposite side of said center line.

3. The child resistant dispensing closure recited in claim 1 wherein said all except one of said plurality of energy planes has a force vector intersecting said horizontal axis when said force is applied to said energy planes.

4. The child resistant dispensing closure recited in claim 1 wherein said one of said energy planes has a force vector which does not intersect said horizontal axis when said force is applied to said energy plane, said force vector being sufficient to produce rotation of said spout.

5. A child resistant dispensing closure comprising a cap and a spout, said cap being adapted for attachment to a container, said cap having a top, an elongated cavity formed in said cap, an opening formed in said cavity communicating with the interior of said dispensing closure, means for rotatably supporting said spout within said cavity, a through passage formed in said spout, said spout having an upper surface, mounting means provided on said spout, said mounting means being adapted to cooperate with said means for rotatably supporting, said spout being adapted for rotation about a horizontal axis between a closed position in which said spout closes off said opening in said cavity and an open position in which said through passage is aligned with said opening in said cavity, a pattern of transverse ribs formed on said top of said cap, at least two ribs formed on said upper surface of said spout, each of said ribs being located forward of the center line of said opening, each of said ribs being provided with an energy plane, each of said energy planes terminating in a planar upper surface, each of said energy planes being configured so as not to allow sufficient purchase to rotate said spout when a manual force is applied to said energy planes, each of said energy planes being located so as to prevent the proper force vector required for rotation of said spout when said force is applied to said energy planes; and at least one rib formed on said upper surface of said spout and being located on the opposite side of said center line of said opening, said rib being provided with an energy plane, said energy plane terminating in a planar upper surface, said energy plane being configured so as to allow sufficient purchase to rotate said spout when a manual force is applied to said energy plane, said energy plane being located so as to produce the proper force vector required for rotation of said spout when said force is applied to said energy plane.

6. The child resistant dispensing closure recited in claim 5 wherein said energy planes located forward of said center line of said opening have force vectors which intersect said horizontal axis of rotation when said force is applied to said energy planes.

7. The child resistant dispensing closure recited in claim 5 wherein said energy plane located on the opposite side of said center line of said opening has a force vector which does not intersect said horizontal axis when said force is applied to said energy planes, said force vector being sufficient to produce rotation of said spout.

8. A child resistant dispensing closure comprising a cap and a spout, said cap including mounting means adapted to be attached to a container, said cap having a top, an elongated cavity provided in said top, means for rotatably supporting said spout within said cavity so that said spout can be rotated about a substantially horizontal axis, said cavity having an opening communicating with the interior of said dispensing closure, said spout being an elongated member having first and second ends, a through passage extending between said ends, means for rotatably mounting said spout so that said spout can be rotated about said axis, said first end of said spout being rotatably mounted on said top by engagement of both of said means for rotatably supporting and mounting, said spout being adapted for rotation between a closed position in which said spout closes off said opening and an open position in which said through passage is aligned with said opening, a pattern of transverse ribs formed on said top of said cap, at least two ribs formed on said upper surface of said spout, each of said ribs being located forward of said center line of said opening, each of said ribs being provided with an energy plane, each of said energy planes being configured so as not to allow sufficient purchase to rotate said spout when a manual force is applied to said energy planes, each of said energy planes being located so as to prevent the proper force vector required for rotation of said spout when said force is applied to said energy planes; each of said energy planes having a force vector which intersects said horizontal axis, and one rib formed on said upper surface of said spout and being located on the opposite side of said center line of said opening, said rib being provided with an energy plane, said energy plane being configured so as to allow sufficient purchase to rotate said spout when a manual force is applied to said energy plane, said energy plane being located so as to produce the proper force vector required for rotation of said spout when said force is applied to said energy plane, said energy plane having a force vector which does not intersect said horizontal axis, said pattern of ribs on said cap and said ribs on said spout together serving to confuse or distract a child or other individual of reduced mental capacity so as to prevent discovery of and inadvertent manipulation of said rib on said opposite side of said center line of said opening.

9. The child resistant dispensing closure recited in claim 8 wherein said spout is situated on said cap such that said spout has relatively little rotational torque.

* * * * *